US008606169B2

(12) United States Patent
Kitayama

(10) Patent No.: US 8,606,169 B2
(45) Date of Patent: Dec. 10, 2013

(54) IMAGE FORMING APPARATUS WITH MOVABLE UPPER UNIT TO ACCESS A SHEET CONVEYANCE PATH

(75) Inventor: Kunihiko Kitayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 12/771,315

(22) Filed: Apr. 30, 2010

(65) Prior Publication Data

US 2010/0284722 A1 Nov. 11, 2010

(30) Foreign Application Priority Data

May 7, 2009 (JP) ..... 2009-112887

(51) Int. Cl.
*G03G 15/00* (2006.01)
*G03G 21/00* (2006.01)

(52) U.S. Cl.
USPC ..... 399/410; 399/124

(58) Field of Classification Search
CPC ..... G03G 2221/1687
USPC ..... 399/407, 408, 410, 125, 124
See application file for complete search history.

(56) References Cited

U.S. PATENT DOCUMENTS

| | | | | |
|---|---|---|---|---|
| 5,737,667 | A * | 4/1998 | Okuda et al. | 399/108 |
| 5,926,684 | A * | 7/1999 | Horiuchi et al. | 399/402 |
| 6,647,243 | B2 | 11/2003 | Sato et al. | |
| 6,671,491 | B1 | 12/2003 | Yamanaka et al. | |
| 7,050,752 | B2 | 5/2006 | Sato et al. | |
| 7,107,006 | B1 | 9/2006 | Sato et al. | |
| 7,120,383 | B2 | 10/2006 | Sato et al. | |
| 7,912,418 | B2 * | 3/2011 | Hattori et al. | 399/405 |
| 2004/0174552 | A1 * | 9/2004 | Miyake et al. | 358/1.12 |
| 2005/0025544 | A1 * | 2/2005 | Yamashita et al. | 399/401 |
| 2006/0231999 | A1 * | 10/2006 | Moteki | 270/58.09 |
| 2007/0160381 | A1 * | 7/2007 | Sato et al. | 399/107 |
| 2009/0097875 | A1 * | 4/2009 | Nagata et al. | 399/92 |

FOREIGN PATENT DOCUMENTS

| | | |
|---|---|---|
| JP | 2002-128355 | 5/2002 |
| JP | 3679701 | 8/2005 |
| JP | 2008-113404 A | 5/2008 |
| JP | 2009-049725 A | 3/2009 |
| JP | 2009-067545 A | 4/2009 |

* cited by examiner

*Primary Examiner* — Judy Nguyen
*Assistant Examiner* — Blake A Tankersley
(74) *Attorney, Agent, or Firm* — Fitzpatrick, Cella, Harper & Scinto

(57) ABSTRACT

An image forming apparatus includes an image forming portion that forms an image on a sheet, an upper unit that is movably mounted above the image forming portion, and a sheet processing apparatus that processes the sheet, having the image formed thereon by the image forming portion, by a processing portion. In addition, a stacking portion on which the sheet processed by the sheet processing apparatus is stacked is disposed between the image forming portion and the upper unit The sheet processing apparatus includes a sheet conveyance path that guides the sheet, having the image formed thereon by the image forming portion, to the processing portion, and the sheet conveyance path is opened with a moving operation of the upper unit.

16 Claims, 11 Drawing Sheets

IMAGE FORMING APPARATUS WITH MOVABLE UPPER UNIT TO ACCESS A SHEET CONVEYANCE PATH

BACKGROUND OF THE INVENTION

1. Field of the Invention

The present invention relates to an image forming apparatus.

2. Description of the Related Art

There are conventionally some image forming apparatuses, such as copying machines, provided with a sheet processing apparatus that successively takes a sheet on which an image is formed into the apparatus to perform a sheet process, such as a binding process, to the sheet, in order to reduce a labor taken for the binding process to the sheet having the image formed thereon, for example. In the image forming apparatus described above, the sheet processing apparatus is arranged at the side of the main body of the image forming apparatus so as to convey the sheet, which is to be processed, from a discharge roller, which is mounted to the main body of the image forming apparatus, to the sheet processing apparatus. However, when the sheet processing apparatus is arranged at the side of the main body of the image forming apparatus, the installation area of the entire image forming apparatus is increased. Further, a support unit, such as a caster, and a rigid frame that independently supports the sheet processing apparatus, and a coupling device for coupling the sheet processing apparatus to the main body of the image forming apparatus have to be provided.

There has been proposed an image forming apparatus provided with a sheet processing apparatus thereon in order to reduce the installation area of the image forming apparatus (refer to U.S. Patent No. 6,671,491). In an image forming apparatus having an image reading apparatus provided at the upper portion thereof, there has been proposed one in which a sheet processing apparatus is arranged to an internal discharge section in the apparatus that is provided in the space between the image reading apparatus and the image forming apparatus. There has also been proposed a sheet processing apparatus having a reverse path formed thereon for duplex print (refer to Japanese Patent Laid-Open No. 2002-128355).

In the image forming apparatus having the sheet processing apparatus arranged in the internal discharge section in the main body of the image forming apparatus, a sheet may be jammed somewhere between the discharge roller of the main body of the image forming apparatus and the sheet processing apparatus. When the jamming occurs, it is considered that a door of the image forming apparatus is opened to open a sheet conveyance path so as to remove the jammed sheet. The sheet processing apparatus having a binding function for performing a binding process staples a sheet bundle with the use of staples. When the staples are replenished, it is also considered that the door of the main body of the image forming apparatus is opened to open the upstream side of the sheet processing apparatus, as in the case of removing the jammed sheet, and then, the staples are replenished.

When the door is at the rear side of the image forming apparatus main body, for example, a user has to perform the jam recovery at the rear of the apparatus main body, which provides poor usability. A desktop image forming apparatus often employs a vertical-feed configuration that is advantageous for reducing the number of the components in order to reduce cost. The vertical-feed configuration means the configuration in which the sheet conveying direction is vertical as viewed from the front of the apparatus. The apparatus with the vertical-feed configuration is mainly configured such that the door at the rear of the main body of the apparatus is opened, when the jamming occurs in the conveyance path from a fixing unit to a discharge unit. In the image forming apparatus provided with the sheet processing apparatus and having the vertical-feed configuration, when the conveyance of the sheet is stopped due to the jamming, the door at the rear of the apparatus is opened to perform a jam recovery of removing the stopped sheet. Therefore, the jam recovery is troublesome. Even when the staples are exchanged or loaded to the sheet processing apparatus having the stapling function, a user has to open the door at the rear of the main body, which is troublesome, and which provides poor usability. Also, when the apparatus is not configured to have the vertical-feed configuration, but is configured such that the door is provided at the side of the main body of the apparatus, the user has to operate from the side, which is again inconvenient for the user.

SUMMARY OF THE INVENTION

The present invention is accomplished in view of the foregoing circumstance, and aims to provide an image forming apparatus in which a user can easily perform a maintenance process for a sheet, which is stopped in the sheet processing apparatus due to the jamming, and for staples.

According to the invention, an image forming apparatus includes: an image forming portion that forms an image on a sheet; a upper unit that is movably mounted above the image forming portion; a sheet processing apparatus that processes the sheet, having the image formed thereon by the image forming portion, by a processing portion; and a stacking portion on which the sheet processed by the sheet processing apparatus is stacked and which is disposed between the image forming portion and the upper unit, wherein the sheet processing apparatus includes a sheet conveyance path that guides the sheet, having the image formed thereon by the image forming portion, to the processing portion, and the sheet conveyance path is opened with a moving operation of the upper unit.

Further features of the present invention will become apparent from the following description of exemplary embodiments with reference to the attached drawings.

DESCRIPTION OF THE EMBODIMENTS

Figure 1:
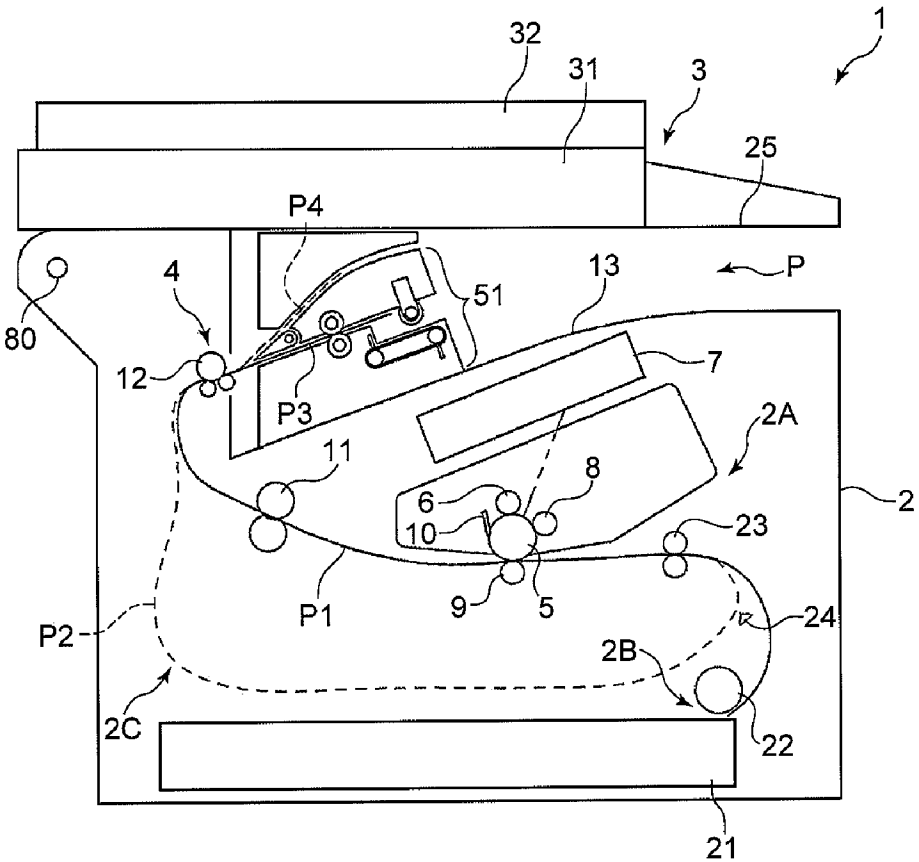
FIG. 1 is a diagram schematically illustrating a configuration of an image forming apparatus provided with a sheet processing apparatus according to an embodiment of the present invention.

An embodiment of the present invention will be described in detail with reference to the drawings. FIG. 1 is a diagram schematically illustrating a configuration of an image forming apparatus provided with a sheet processing apparatus according to the embodiment of the present invention. An image forming apparatus 1 has a main body 2 serving as an image forming portion provided with a printer portion 2A of an electrophotographic system and the like. A sheet processing apparatus 51 performing a process (post-process), such as a stapling process, to a sheet on which an image is formed by the printer portion 2A is provided above the main body of the image forming apparatus 2 (hereinafter referred to as a main body). A reader scanner portion 3 serving as an image reading apparatus, which is an upper unit for reading an image of an original, is provided above the sheet processing apparatus 51 so as to be capable of being opened and closed.

A discharge space P into which a sheet is discharged is formed between the reader scanner portion 3 and the top surface of the main body 2, and the sheet processing apparatus 51 is provided in the discharge space. The sheet, which is processed by the sheet processing apparatus 51 after the image is formed by the printer portion 2A, is discharged into the discharge space P. Specifically, the image forming apparatus 1 is the one in which a sheet is discharged in the apparatus, i.e., in which a sheet is discharged into the discharge space P formed between the reader scanner portion 3 and the main body 2. The reader scanner portion 3 has a reader scanner housing 31 provided with an original base plate glass and a reading optical system, not illustrated, and a pressure plate 32 for holding the original. The reader scanner portion 3 reads the image of the original placed on the original base plate glass. An operation portion 25 of the image forming apparatus 1 is fixed to the reader scanner housing 31. The reader scanner portion 3 is provided to be capable of pivoting in the vertical direction about a hinge 80 with respect to the printer portion 2A. When the reader scanner portion 3 is vertically pivoted, the discharge space P can be opened.

The reader scanner portion 3 is provided with the operation portion 25 for operating the image forming apparatus 1 by a user. The side where the user who operates the operation portion 25 stands is defined as the front (front side) of the image forming apparatus 1. Specifically, the right side in FIG. 1 is the front side of the image forming apparatus 1.

In FIG. 1, a sheet feed portion 2B includes a sheet cassette 21 that stacks and accommodates sheets, a feed roller 22 that feeds the uppermost sheet in the sheet cassette 21, and a pair of registration rollers 23. A sheet re-conveying portion 2C conveys again the sheet, on which the image is formed on a first surface at the printer portion 2A, to the printer portion 2A. The printer portion 2A includes a photosensitive drum 5 serving as an image bearing member, a charging roller 6 arranged around the photosensitive drum 5 for primarily charging the photosensitive drum 5, an exposure device that irradiates laser beams to the photosensitive drum 5, a development device 8, a transfer charging roller 9, a cleaning device 9, and the like. A fixing device 11 is arranged at the downstream side of the photosensitive drum 5. The sheet processing apparatus performs not only the stapling process (binding process) to the sheet discharged from the printer portion 2A, but also a sorting process, alignment process, punching process, etc. After performing the stapling process or other process, the sheet processing apparatus 51 discharges the sheet into the discharge space P.

The image forming operation of the image forming apparatus 1 thus configured will next be described. When a start button (not illustrated) on the operation portion 25 is depressed, the reader scanner portion 3 reads an image of an original. At the printer portion 2A, the exposure device 7 irradiates the laser beam based upon the image of the original read by the reader scanner portion 3 onto the photosensitive drum 5 that is primarily charged by the charging roller 6, whereby an electrostatic latent image is formed on the photosensitive drum 5. Thereafter, the electrostatic latent image is developed into a toner image by the development device 8, thereby being made visible. The toner image on the photosensitive drum 5 is transferred by the transfer charging roller 9 constituting the transfer portion onto the sheet, which is conveyed in synchronized timing by the pair of registration rollers 23 of the sheet feed portion 2B. The residual toner on the photosensitive drum 5 is removed by the cleaning device 10, and the residual charges on the photosensitive drum are eliminated by a static eliminating device (not illustrated).

Then, the sheet on which the toner image has been transferred is conveyed to the fixing device 11 where heat and pressure are applied to the sheet to permanently fix the toner image on the sheet. Thereafter, the sheet on which the toner image is fixed is conveyed to the sheet processing apparatus 51 via the discharge roller 12 provided to a sheet discharge portion 4, and subject to the stapling process by the sheet processing apparatus 51. Then, the sheet is discharged onto a discharge tray 13 in the discharge space P. The discharged sheets are stacked on the discharge tray 13 serves as a stacking portion. A sheet passing path (sheet path) P1 indicated by a solid line in FIG. 1 is provided from the sheet feed portion 2B to the sheet discharge portion via the transfer portion. A duplex path P2 indicated by a broken line is provided to the sheet re-conveying portion 2C. During the duplex print, the sheet on which the image is formed on the first surface is reversed when passing through the duplex path P2, and again directs toward the transfer portion. Thereafter, the sheet is subject to the transfer process, fixing process, and the discharging process, whereby the duplex print is completed, and then, the sheet is stacked on the discharge tray 13. During the duplex print described above, after the trailing end of the sheet completely passes through the fixing roller 11, the discharge roller 12 constituting a reverse conveying portion is allowed to reversely rotate at a predetermined timing to perform the sheet reverting operation. In this case, a part of the sheet is exposed to the outside of the apparatus from the discharge roller 12.

Figure 2:
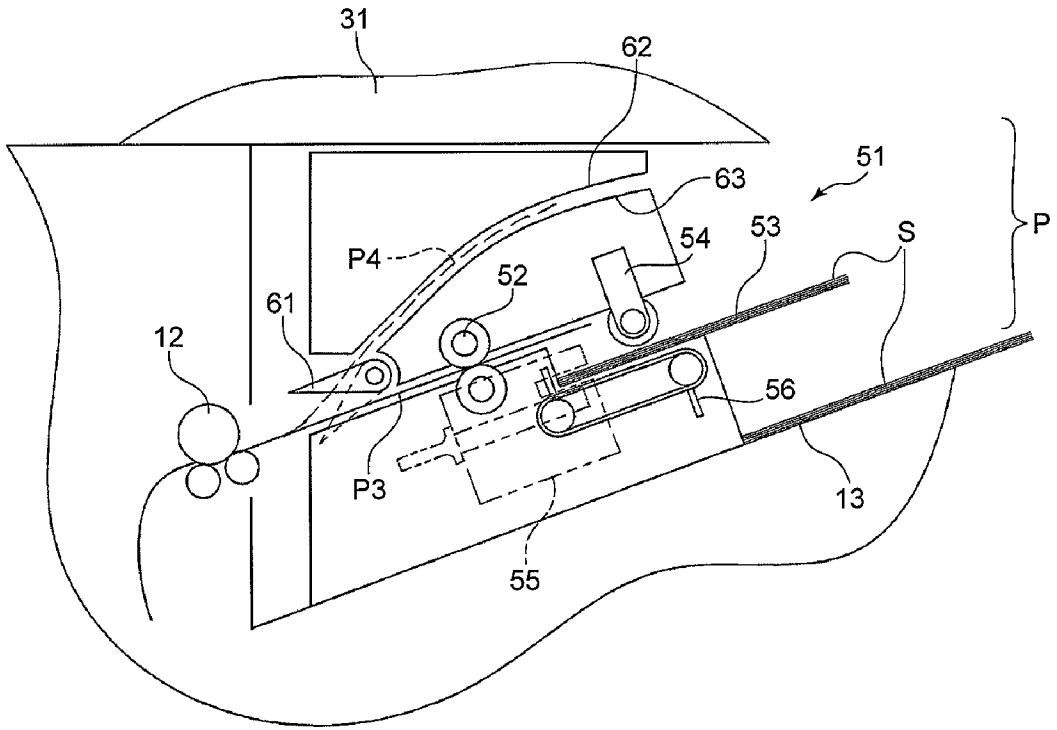
FIG. 2 is a diagram describing the configuration of the sheet processing apparatus.

FIG. 2 is a diagram describing the configuration of the sheet processing apparatus 51 provided at the discharge space P. The sheet processing apparatus 51 includes a process tray 53 for temporarily stacking the sheet in order to perform the stapling process to the sheet, a conveying roller 52 for conveying the sheet onto the process tray 53, and an offset roller 54 that performs the alignment operation to the sheet S on the process tray 53. The sheet processing apparatus 51 also includes a stapler 55 for performing the stapling process to the bundle of the sheet S stacked onto the process tray 53, and a sheet bundle conveying portion 56 that conveys the bundle of the sheet S, which has been subject to the stapling process, on the process tray 53 to the discharge roller 13. In the present embodiment, the upper portion of the sheet processing apparatus 51 can be separated from the lower portion thereof.

In FIG. 2, a reverse path P4 is a reverse conveyance path formed on the top surface of the sheet processing apparatus 51. An upper guide 62 forms the top surface of the reverse path P4, and a lower guide 63 forms the bottom surface of the reverse path P4. As described before, a part of the sheet projects from the discharge roller 12 to perform a switch back operation during the reverse operation of the duplex print. In this case, the sheet projecting from the discharge roller 12 toward the sheet processing apparatus enters the reverse path P4, so that the sheet is switched back in the reverse path P4 in the sheet processing apparatus 51.

A conveyance path P3 is a sheet conveyance path in the sheet processing apparatus 51 through which the sheet, which has an image formed thereon and is to be processed, passes. The stapler 55 is provided to the sheet conveyance path P3. Specifically, the conveyance path P3 is a conveyance path for guiding the sheet having the image formed thereon in the main body to the process tray 53. The sheet is guided to either one of the conveyance path P3 and the reverse path P4 by a switching member 61. Specifically, during the reverse operation of the duplex print, the sheet enters the reverse path P4 by the movement of the switching member 61 to the position indicated by a broken line. When the sheet is guided to the process tray 53 in order to perform the stapling process, the switching member 61 is changed to the position indicated by a solid line, whereby the sheet enters the conveyance path P3.

The process when the sheet is jammed between the sheet processing apparatus 51 thus configured and the discharge roller 12 will be described. When the leading end of the jammed sheet projects into the discharge space P through the conveyance path P3 or the reverse path P4 of the sheet processing apparatus 51, a user holds the leading end of the sheet to pull the sheet out, thereby being capable of operating the jam recovery from the front (right side in FIG. 1) of the main body 2. On the other hand, if a user opens the door at the rear of the main body 2 to perform the jam recovery from the rear of the image forming apparatus 1 when the leading end of the sheet does not pass through the conveyance path P3 or the reverse path P4, visibility and operability are poor. There may also be a case in which the sheet is torn during the jam recovery. In this case, it is difficult to remove the torn sheet from the rear of the image forming apparatus 1.

Figure 3:
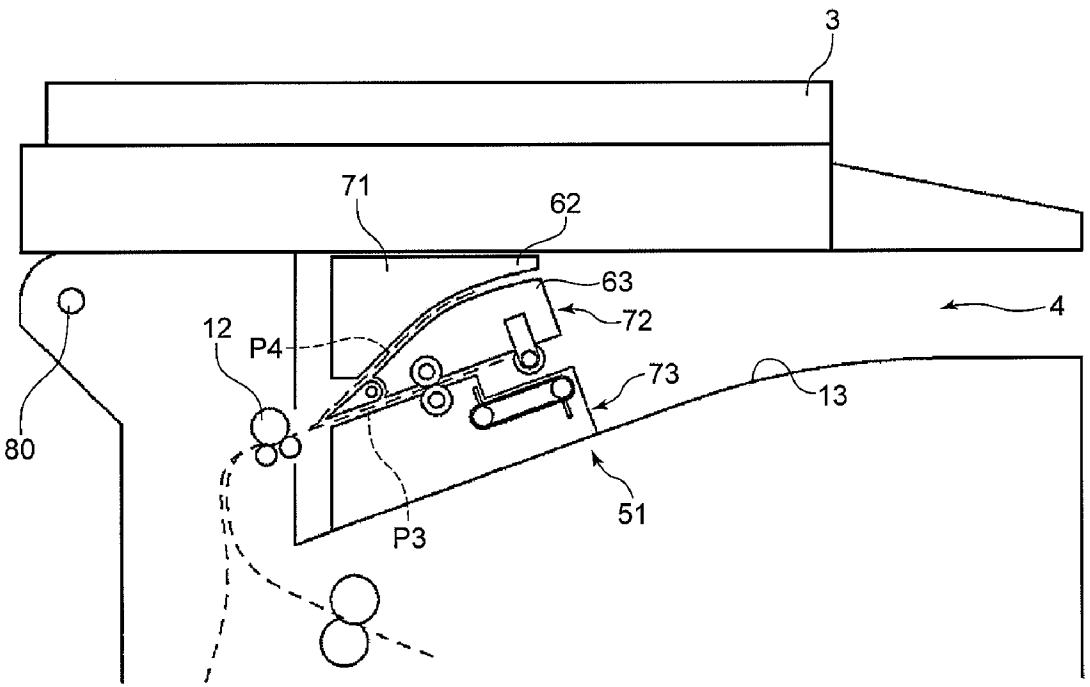
FIG. 3 is a diagram describing the unit configuration of the sheet processing apparatus.

In the present embodiment, the conveyance path P3 or the reverse path P4 can be opened according to the opening operation of the movable reader scanner portion 3. The sheet processing apparatus 51 includes three units that are a guide-unit-on-reverse-path 71, a sheet-process upper unit 72 that is a movable guide portion constituting the top surface of the conveyance path P3, and a sheet-process lower unit 73, as illustrated in FIG. 3. The guide-unit-on-reverse-path 71 is provided with an upper guide 62, while the sheet-process upper unit 72 includes a lower guide 63 and the upper portion of the sheet processing apparatus 51. The lower surface of the sheet-process upper unit 72 serving as a sheet guide portion constitutes the conveyance path P3, and the sheet-process upper unit 72 extends to the position above the process tray 53. The sheet-process lower unit 73 constitutes the bottom surface of the conveyance path P3, and includes the lower portion of the sheet processing apparatus 51.

Figure 4A:
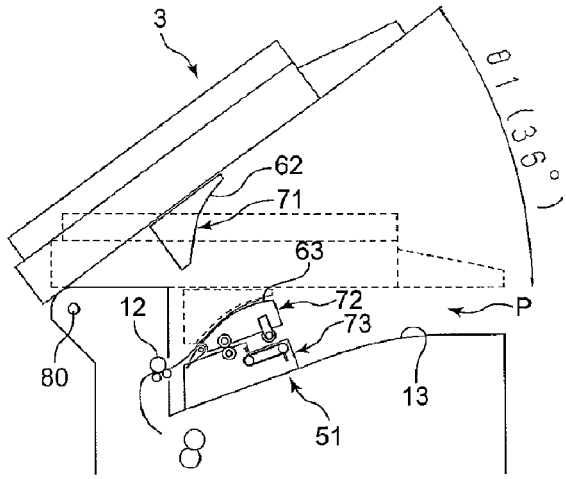
FIG. 4A is a diagram illustrating an opening operation of a reader scanner portion provided to the image forming apparatus.

The guide-unit-on-reverse-path 71 is held by the bottom surface of the reader scanner portion 3, wherein it pivots about the hinge 80 with the opening movement (upward pivot) of the reader scanner portion 3 as illustrated in FIG. 4A. Thus, when a user opens the reader scanner portion 3 at an angle of 36 degrees (θ1 in the figure), the reverse path P4 is opened, whereby the jam recovery at the portion from the discharge roller 12 to the reverse path P4 can be done.

Figure 4B:
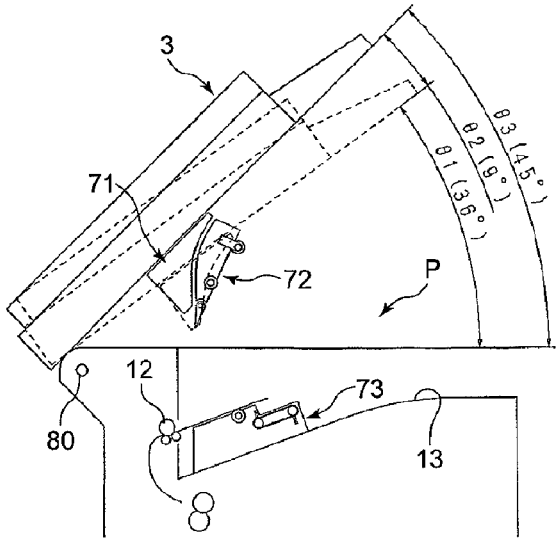
FIG. 4B is a diagram illustrating the opening operation of the reader scanner portion provided to the image forming apparatus.

When the sheet is jammed in the conveyance path P3 of the sheet processing apparatus 51, a user opens the reader scanner portion 3 at an additional angle of 9 degrees (θ2 in the figure) from θ1 as illustrated in FIG. 4B. In this case, the reader scanner portion 3 is opened at an angle of 45 degrees (θ3 in the figure) from the normal state. Since the reader scanner portion 3 is opened as described above, the sheet-process upper unit 72 is upwardly pivoted about the hinge 80, whereby the conveyance path P3 is opened. Therefore, the jam recovery at the portion from the discharge roller 12 to the reverse path P3 can be done.

In the present embodiment, the operation angle θ1, which is a first moving operation amount of a first opening operation for opening the reverse path P4, is 36 degrees, while the operation angle θ2, which is a second moving operation amount of a second opening operation for opening the conveyance path P3, is set to be small such as 9 degrees. Specifically, the operation angle θ1, which is one of the operation angle θ1 for opening the reverse path P4 of two paths P3 and P4 of the reader scanner portion 3 and the operation angle θ2 for opening the conveyance path P3, is set to be smaller than the other operation angle θ2. This is because the second opening operation aims to change the opened portion. If the reverse path P4 and the conveyance path P3 are simultaneously opened, the operation angle of the reader scanner portion 3 needs to be 72 degrees, which is double 36 degrees. However, since the opened portion is only one, it is not necessary to open the reader scanner portion 3 that far.

As the opening operation angle θ3 of the reader scanner portion 3 increases, it becomes difficult for a user to reach the reader scanner portion 3, which deteriorates the usability. Therefore, the opening operation angle θ3 is desired to be small. Accordingly, the operation angle θ2 for the second opening operation is set to be small in order to make the total operation angle θ3 small. As a result, the second opening operation can be made with the second moving operation amount (operation angle θ2) that is smaller than the first moving operation amount (operation angle θ1) of the reader scanner portion 3 for the first opening operation. The opening mechanism for opening the reverse path P4 and the conveyance path P3 by the opening operation of the reader scanner portion 3 will be described below.

There may be a case in which, when a sheet is jammed as climbing onto both the discharge roller 12 and the reverse path P4, the sheet becomes an accordion shape, and is jammed in the reverse path P4. In this state, when the sheet-process upper unit 72 is moved upward, the sheet is pulled by both the discharge roller 12 and the reverse path P4, with the result that the sheet might likely be torn. In view of this, in the embodiment, the opening operation of the reader scanner portion 3 includes a two-step operation, which are the first and the second opening operations, as described above, whereby the reverse path P4 and the conveyance path P3 are not simultaneously opened, but successively opened. Specifically, it is configured such that the reverse path P4, which is one of the reverse path P4 and the conveyance path P3, and the conveyance path P3, which is the other one, are successively opened by the later-described opening mechanism with the opening operation of the reader scanner portion 3. Since the reverse path P4 is opened first as described above, the sheet jammed in the reverse path P4 is removed, and then, the conveyance path P3 can be opened.

Figure 5:
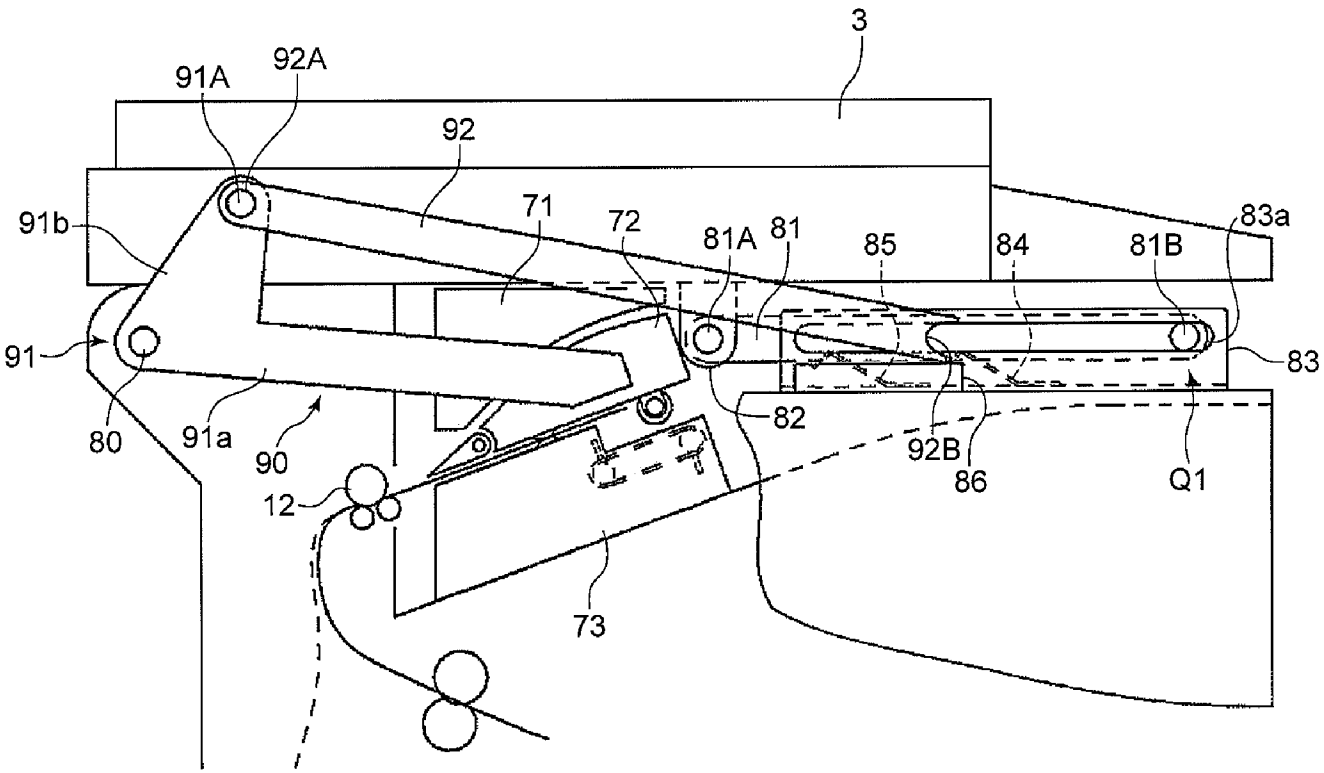
FIG. 5 is a diagram describing the configuration of an opening mechanism that opens a reverse path and a conveyance path with the opening of the reader scanner portion.

The opening mechanism that is an interlocking portion for successively opening the reverse path P4 and the conveyance path P3 of the sheet processing apparatus through the interlocking movement of the reader scanner portion 3 and the sheet-process upper unit 72 will next be described. FIG. 5 is a diagram describing the configuration of the opening mechanism that successively opens the reverse path P4 and the conveyance path P3 with the opening operation of the reader scanner portion. FIG. 5 illustrates an opening mechanism 90 in the normal state in which the reader scanner portion and the reverse path P4 and the conveyance path P3 are closed.

In FIG. 5, a first arm 81 is a first link member for coupling the reader scanner portion 3 and the printer portion 2A. The first arm 81 is supported by a shaft portion 81A provided at the bottom surface of the reader unit 3 and having a hinge 82 mounted to one end, thereby being supported to the reader unit 3 so as to be capable of pivoting. A shaft (hereinafter referred to as end shaft) 81B is mounted to the other end of the first arm 81. The end shaft 81B is provided to be movable along a guide channel portion 83*a* of a guide member 83 mounted to the printer portion side. With this configuration, the first arm 81 changes its position and posture according to the opening angle of the reader scanner portion 3.

Figure 6A:
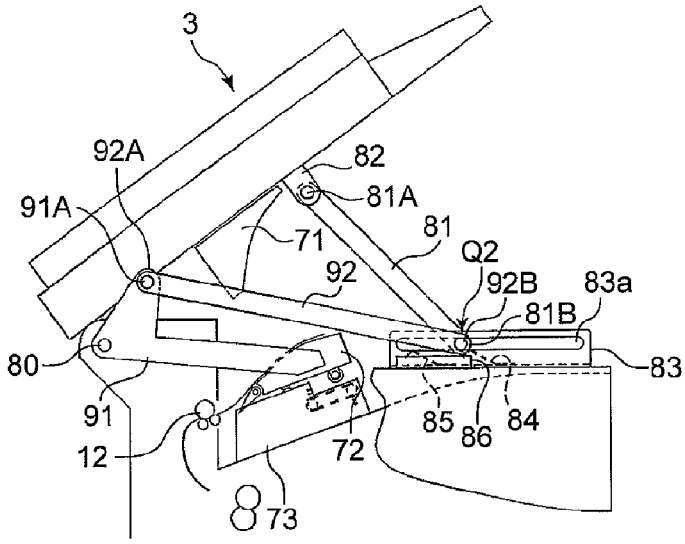
FIG. 6A is a first diagram describing the opening operation of the reverse path and the conveyance path by the opening mechanism.

In the state (state 1) in which the reader scanner portion 3 is closed as illustrated in FIG. 5, for example, the end shaft 81B of the first arm 81 is located at one end indicated by Q1 of the guide channel portion 83*a*. In the state (state 2) in which the reverse path P4 is opened as illustrated in FIG. 6A, the end shaft 81B is positioned at the central part of the guide channel portion 83*a* indicated by Q2. In the state (state 3) in which the conveyance path P3 of the sheet processing apparatus is opened as illustrated in FIG. 6B, the end shaft 81B is positioned at the other end of the guide channel portion 83*a* indicated by Q3.

Figure 6B:
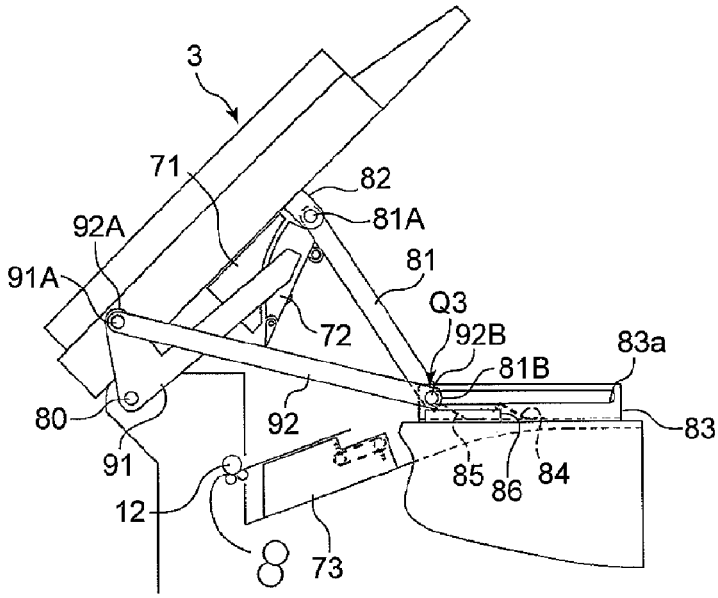
FIG. 6B is the first diagram describing the opening operation of the reverse path and the conveyance path by the opening mechanism.

In FIGS. 5, 6A, and 6B, a first plate spring member 84 can apply a click feeling to the first arm 81 when the first arm 81 changes from the state 1 to the state 2. The first plate spring member 84 also has a function of holding the posture of the first arm 81 and the reader scanner portion 3 to allow them to stand by themselves, even if the user release his or her hand from the reader scanner portion 3.

In FIG. 5, a second arm 91 is a second link member that couples the hinge 80 and the sheet-process upper unit 72. The second arm 91 is held so as to be capable of pivoting about the hinge 80, and has two arm portions 91*a* and 91*b*. The arm portion 91*a* is held by the side face of the sheet-process upper unit 72 with an allowance. With this configuration, the sheet-process upper unit 72 is held so as to be capable of pivoting about the hinge 80 through the second arm 91. The other arm portion 91*b* is provided with a hinge shaft 91A.

A third arm 92 is a third link member that couples the first arm 81 and the second arm 91 for converting the moving operation (opening/closing operation) of the reader scanner portion 3 into the opening/closing operation of the sheet-process upper unit 72. An end hole 92A is formed at one end of the third arm 92. The third arm 92 is held by the second arm 81 so as to be capable of pivoting through the end hole 92A and the hinge shaft 91A of the second arm 91. A U-shaped end channel 92B having one end open is formed at the other end of the third arm 92. The end shaft 81B of the first arm 81 is engageable with the end channel 92B.

During the period from the state 1 illustrated in FIG. 5 to the point immediately before the state 2 illustrated in FIG. 6A, the end channel 92B of the third arm 92 and the end shaft 81B of the first arm 81 are separated from each other, which means they are not engaged with each other. Since they are not engaged in the period from the state 1 to the state 2 as described above, the operation is not transmitted to the sheet-process upper unit 72 even if the reader scanner portion 3 is opened/closed.

On the other hand, during the period from the state 2 illustrated in FIG. 6A to the state 3 illustrated in FIG. 6B, the end shaft 81B of the first arm 81 moves by the operation of opening the reader scanner portion 3, thereby being engaged with the end channel 92B of the third arm 92. Thereafter, when the reader scanner portion 3 is further opened, the end shaft 81B of the first arm 81 further moves, whereby the third arm 92 (the end channel 92B of the third arm 92) is pressed by this movement to move to the left in the figure. Since the third arm 92 moves to the left in the figure as described above, the second arm 91 pivots in the counterclockwise direction about the hinge 80. With this pivot movement, the sheet-process upper unit 72 pivots, and the conveyance path P3 is opened. Since the conveyance path P3 is opened, the process tray 53, a part of which is covered by the stapler 55 and the sheet-process upper unit 72, is exposed.

In FIGS. 5, 6A, and 6B, a second plate spring member 85 can apply a click feeling to the first arm 81 when the first arm 81 changes from the state 2 to the state 3. The second plate spring member 85 also has a function of holding the posture of the first arm 81, the reader scanner portion 3, and the sheet-process upper unit 72 to allow them to stand by themselves, even if the user release his or her hand from the reader scanner portion 3. A rough guide 86 can allow the end channel 92B of the third arm 92 to keep the engageable position during the stand-by state in which it is not engaged with the end shaft 81B of the first arm 81.

The opening operation of the opening mechanism 90 thus configured for opening the reverse path P4 and the conveyance path P3 will next be described. When a jam sensor (not illustrated) detects that a sheet is jammed between the discharge roller 12 and the sheet processing apparatus 51, a user opens the reader scanner portion 3 until he or she can feel the click sense. Thus, the reader scanner portion 3 is opened with the angle of 36 degrees as illustrated in FIG. 4A, whereby the reverse path P4 is opened.

The opening mechanism 90 is changed from the state illustrated in FIG. 5 to the state illustrated in FIG. 6A with the opening operation of the reader scanner portion 3 described above. Specifically, the first arm 81 used for performing the first opening operation for opening the reverse path P4, which is one of the conveyance path P3 and the reverse path P4, moves, while moving the end shaft 81B along the guide channel portion 83*a* of the guide member 83 with the opening operation of the reader scanner portion 3. Thereafter, the end shaft 81B is positioned at the central part of the guide channel portion 83*a* indicated by Q2 in FIG. 6A.

On the other hand, when a jammed sheet is present in the conveyance path P3, the user opens more the reader scanner portion 3 until he or she feels the click sense. Thus, the reader scanner portion 3 is opened more with the angle of 9 degrees as illustrated in FIG. 4B, whereby the conveyance path P3 is opened. The opening mechanism 90 is changed from the state illustrated in FIG. 6A to the state illustrated in FIG. 6B with the opening operation of the reader scanner portion 3. Specifically, the first arm 81 moves the end shaft 81B along the guide channel portion 83*a* of the guide member 83 with the opening operation of the reader scanner portion 3, so that the end shaft 81B is positioned at the end of the guide channel portion 83*a* indicated by Q3 in FIG. 6B.

Figure 7:
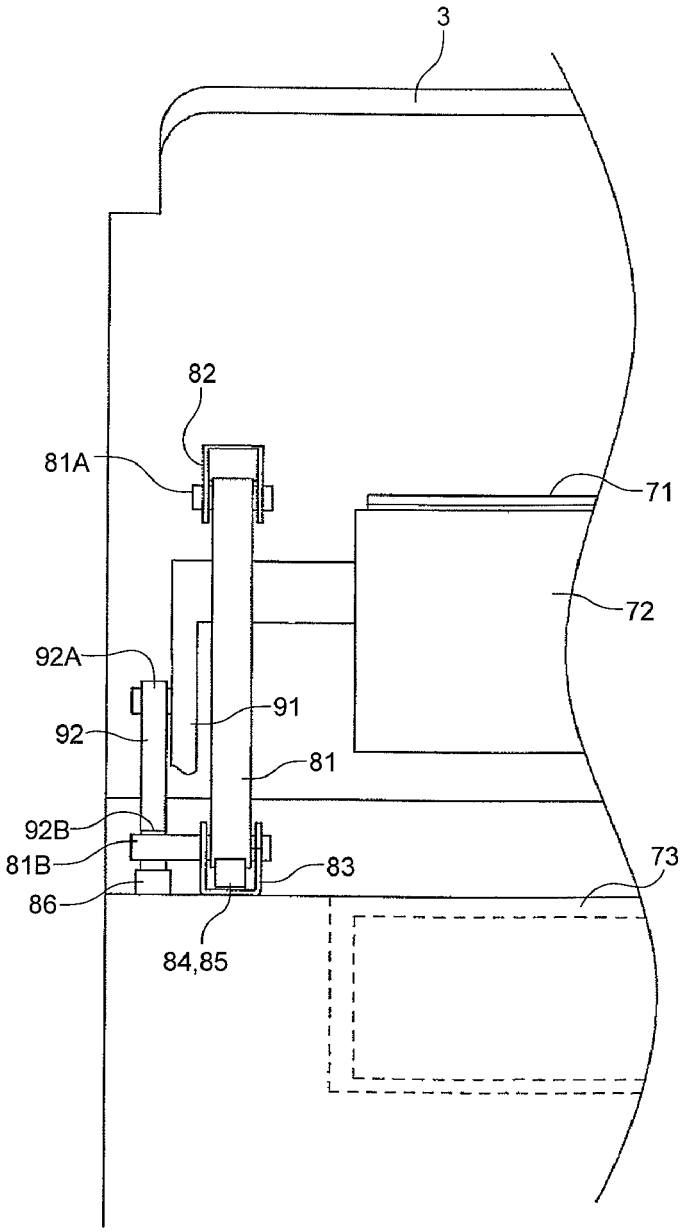
FIG. 7 is a second diagram describing the opening operation of the reverse path and the conveyance path by the opening mechanism.

When the end shaft 81B is moved as described above, the end channel 92B of the third arm 92 and the end shaft 81B of the first arm 81 are engaged with each other as illustrated in FIG. 7, so that the third arm 92 is pressed to move. Further, with this movement, the second arm 91 that performs the second opening operation for opening the conveyance path P3, which is the other one of the conveyance path P3 and the reverse path P4, pivots about the hinge 80. With the pivot movement of the second arm 91, the sheet-process upper unit 72 pivots upwardly as illustrated in FIG. 6B, whereby the conveyance path P3 is opened. Since the conveyance path P3 and the reverse path P4 are successively opened with the opening operation of the reader scanner portion 3 as described above, the jammed sheet can be removed. The reader scanner portion 3 is pivoted downwardly after the jammed sheet is removed, whereby the closed operation of the reader scanner portion 3 is performed, and the conveyance path P3 and the reverse path P4 are closed. In order to allow the sheet to smoothly pass through the conveyance path P3 and the reverse path P4 when the conveyance path P3 and the reverse path P4 are closed, three divided units 71, 72, and 73 has to be positioned.

Figure 8:
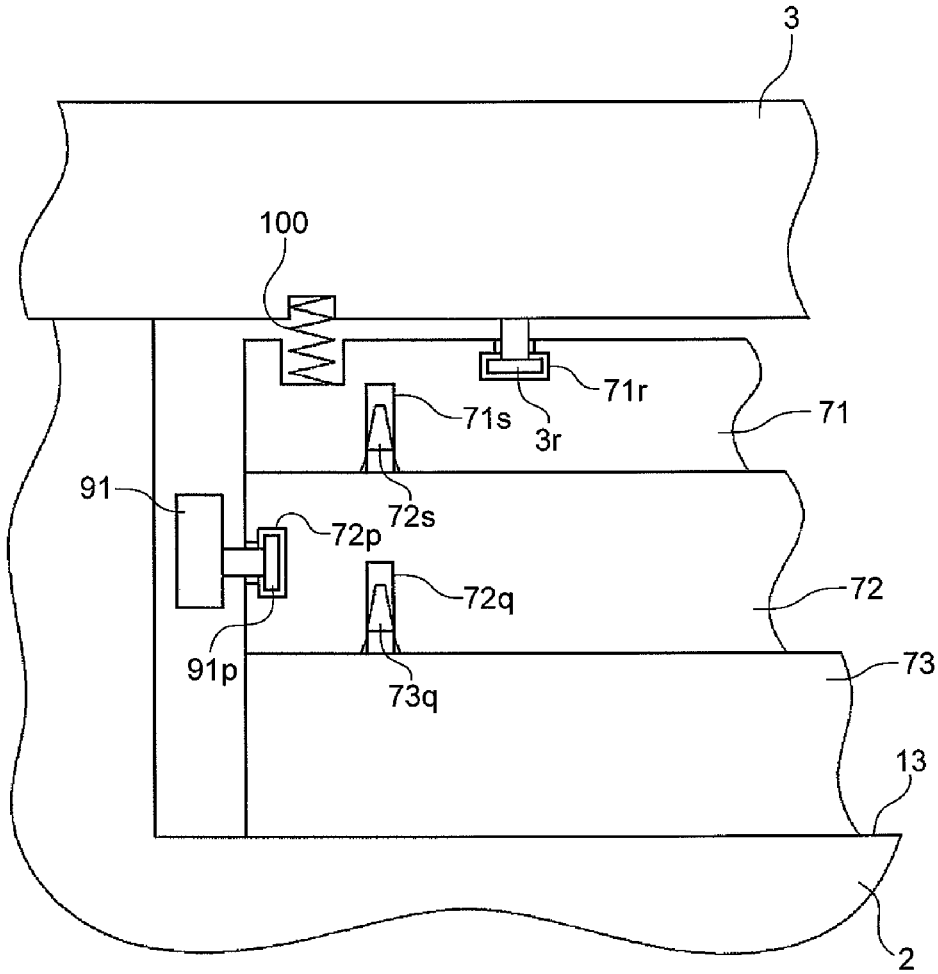
FIG. 8 is a diagram illustrating the state in which three units in the sheet processing apparatus are positioned.

FIG. 8 is a diagram illustrating the state in which three units 71, 72, and 73 are positioned as described above. The sheet-process lower unit 73 is fixed to the discharge tray 13. The positioning of the sheet-process upper unit 72 with respect to the sheet-process lower unit 73 is performed through the engagement between a pin 73*q* of the sheet-process lower unit 73 and a channel portion 72*q* of the sheet-process upper unit 72. The sheet-process upper unit 72 has a channel portion 72*p*, and the second arm 81 has a projection 91*p*. Since the projection 91*p* of the second arm 81 is engaged with the channel portion 72*p* of the sheet-process upper unit 72 with an allowance, the sheet-process upper unit 72 is held by the second arm 81 with the allowance as described previously.

The guide-unit-on-reverse-path 71 has a channel portion 71*r*, and the reader scanner portion 3 has a projection 3*r*. The channel portion 71*r* of the guide-unit-on-reverse-path 71 and the projection 3*r* of the reader scanner portion 3 are engaged with each other with an allowance, whereby the guide-unit-on-reverse-path 71 is held by the bottom surface of the reader scanner portion 3 with an allowance. The positioning of the guide-unit-on-reverse-path 71 with respect to the sheet-process upper unit 72 with an allowance is performed through the engagement between a pin 72*s* of the sheet-process upper unit 72 and a channel portion 71*s* of the guide-unit-on-reverse-path 71.

The respective three units 71, 72, and 73 are positioned at the respective predetermined positions with their own weights. However, when the operation force of the mechanism in the sheet processing apparatus is great, the units 71, 72, and 73 might move during the operation. Therefore, a spring 100 is provided between the reader scanner portion 3 and the guide-unit-on-reverse-path 71 as illustrated in FIG. 8. The spring 100 holds the units 71, 72, and 73 downwardly, whereby the movement of the units 71, 72, and 73 during the operation can be prevented.

According to the opening mechanism 90 in the present embodiment, the reverse path P4 and the conveyance path P3 can successively be opened with the opening/closing operation of the reader scanner portion 3, whereby the jam recovery can easily be carried out. In the opening mechanism 90 (the first to the third arms 81, 91, and 92 of the opening mechanism 90), the operation angle θ2 of the second opening operation for opening the conveyance path P3 can be set small, whereby the total operation angle θ3 can be decreased. Therefore, it can be prevented that the operation range of the reader scanner portion 3 unnecessarily increases, which provides excellent operability.

As described above, since the sheet processing apparatus 51 is configured to be capable of opening and closing in order to open the conveyance path P3 and the reverse path P4, the user can carry out the jam recovery from the side of the sheet processing apparatus. Accordingly, in many desktop image forming apparatuses, the user can carry out the jam recovery of the sheet processing apparatus 51 from the front, which improves usability. Specifically, when the conveyance path P3 and the reverse path P4 are opened and closed in synchronism with the opening/closing operation of the reader scanner portion 3 as in the present embodiment, the jam recovery, which occurs in the sheet processing apparatus 51, can simply be carried out.

In the present embodiment, the reverse path P4 is arranged above the conveyance path P3. However, it is also considered that the conveyance path P3 is arranged above the reverse path P4. In this case, the operation angle θ1 of the first opening operation for opening the conveyance path P3 is 36 degrees, while the operation angle θ2 of the second opening operation for opening the reverse path P4 is set to be small such as 9 degrees. In this case, the first opening operation is performed with the first moving operation amount smaller than the second moving operation amount of the reader scanner portion 3 for the second opening operation.

In the present embodiment, the opening mechanism 90 is formed by a link mechanism. However, a gear or a toothed belt may be employed. In this case, the same effect can be obtained by the mechanism in which the rotation moving angle of the sheet-process upper unit 72 is increased more than the operation angle of the reader scanner portion 3. In the above description, the top surface of the reverse path P4 is composed of the guide-unit-on-reverse-path 71 (the upper guide 62 of the guide-unit-on-reverse-path 71). However, the top surface of the reverse path P4 is not always needed for the reverse of the sheet. Accordingly, the present invention can be applicable even if the guide-unit-on-reverse-path 71 is not provided. Further, the configuration provided with the reverse path has been described above, however, the effect described above can be obtained even in the sheet processing apparatus not having the reverse path with the configuration in which the conveyance path P3 can be opened and closed in synchronism with the opening/closing operation of the reader scanner portion 3.

Since a part of the sheet processing apparatus is configured to be capable of being opened and closed as in the present invention, the usability involved with the jam recovery is improved. In addition, the maintenance property involved with the staples is also improved. Since a part of the sheet processing apparatus is configured to be capable of being opened and closed, the user can exchange or load the staples from the downstream side of the sheet processing apparatus in the sheet conveying direction (from the front of the image forming apparatus 1).

Figure 9:
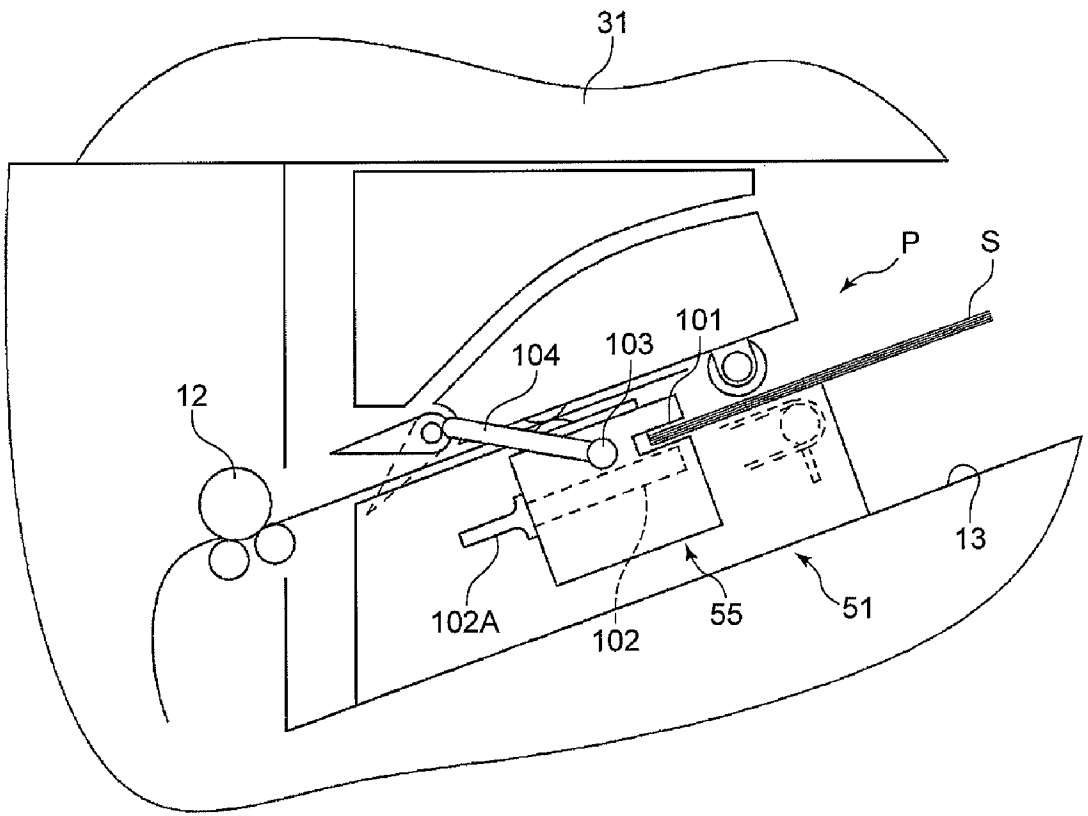
FIG. 9 is a diagram describing the configuration of a stapler provided to the sheet processing apparatus.

The operation of exchanging the staples in the sheet processing apparatus will next be described. FIG. 9 is a diagram describing the configuration of the stapler provided to the sheet processing apparatus 51. The stapler 55 that is a binding portion (processing portion) for performing a sheet binding process with the staples is provided at the thrust end of the sheet processing apparatus 51. The stapler 55 includes a binding processing portion 101 and a staple cartridge 102. The stapler 55 can bind a bundle of the sheet S stacked on the process tray 53 by inserting the staples from below.

The staple cartridge 102 is a storage chamber of the staples, provided below the binding processing portion 101, detachable to the stapler 55, and the staples can appropriately be replenished. The stapler 55 includes a hinge 103 and a tray bar 104, wherein the stapler 55 can be pivoted about the hinge 103 with the operation of the tray bar 104.

Figure 10:
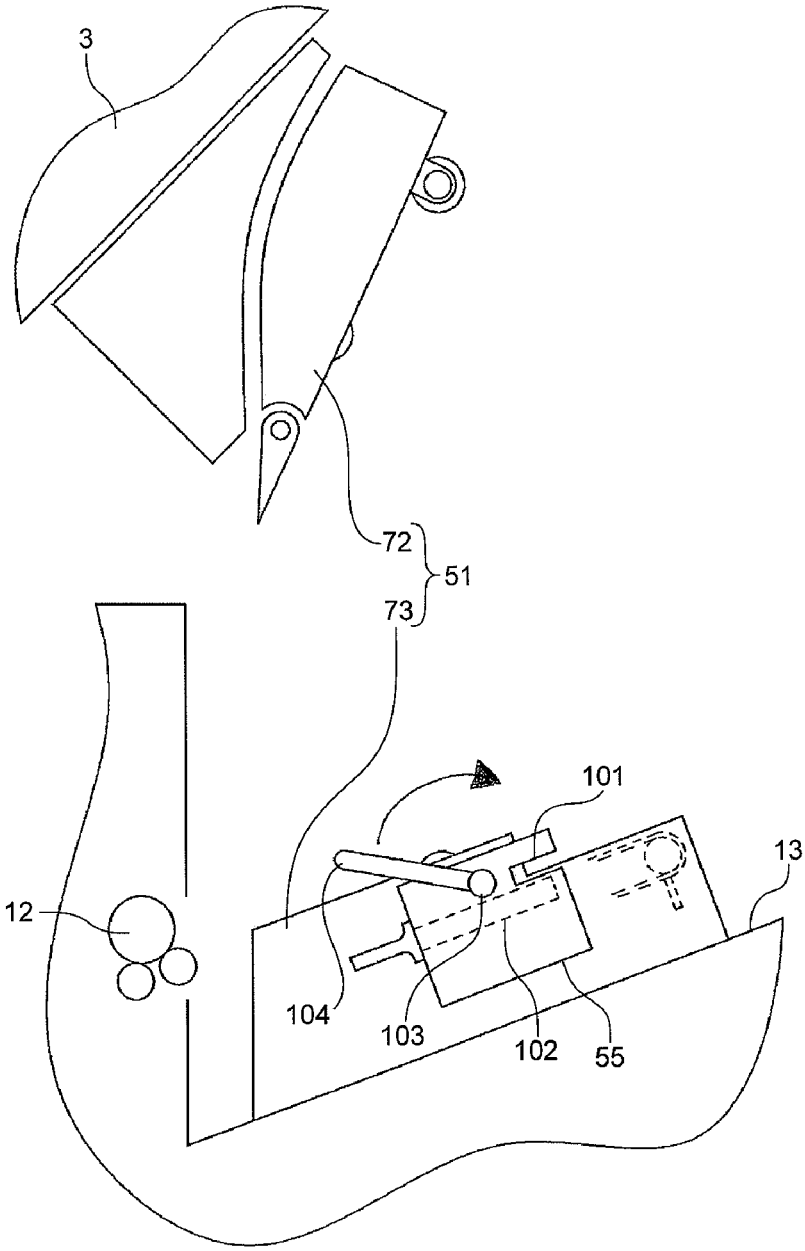
FIG. 10 is a first diagram illustrating a procedure of exchanging staples of the stapler.

The procedure of exchanging the staples will next be described with reference to FIGS. 10 and 11. FIG. 10 illustrates a state in which the reader scanner portion 3 is pivoted upwardly. In this case, the sheet processing apparatus 51 is divided into the upper part and the lower part as described previously. The stapler 55 is provided to the sheet-process lower unit 73, which is a lower guide member constituting the lower part of the sheet processing apparatus 51. Accordingly, when the reader scanner portion 3 is pivoted upwardly, an open space serving as a removing space is formed above the stapler 55. As a result, a user can make an access to the stapler 55 from the downstream side of the sheet processing apparatus 55 in the sheet conveying direction.

Figure 11A:
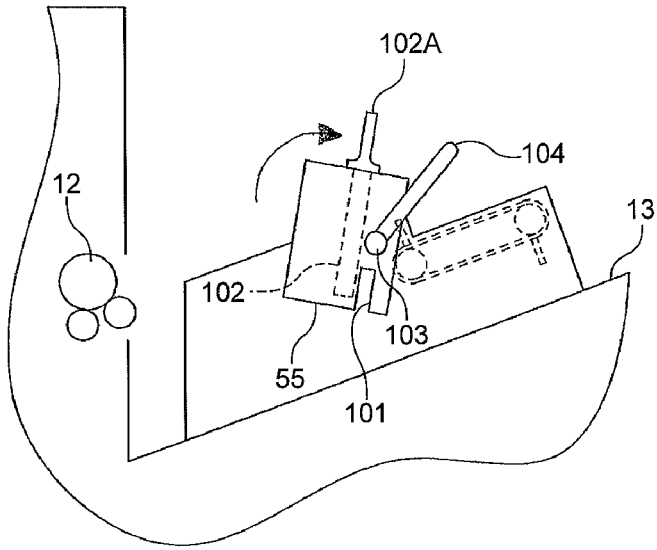
FIG. 11A is a second diagram illustrating a procedure of exchanging staples of the stapler.
Figure 11B:
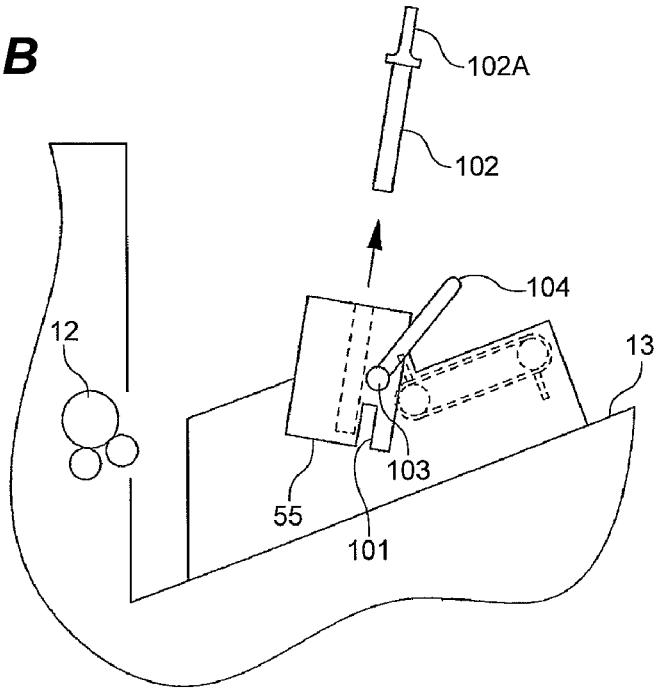
FIG. 11B is a second diagram illustrating the procedure of exchanging staples of the stapler.

When the lever 104 is pulled down in the forward direction (clockwise direction) of the sheet processing apparatus 51 as illustrated in FIG. 10, the stapler 55 pivots, whereby a handle 102A of the staple cartridge 102 is exposed upwardly as illustrated in FIG. 11A. Thereafter, the user pulls out the exposed handle 102A as illustrated in FIG. 11B, whereby the staples in the staple cartridge 102 can be loaded and exchanged. After the loading and exchange of the staples are completed, the user inserts the staple cartridge 102 into the stapler, and then, pulls down the lever 104 in the depth direction (counterclockwise direction) of the sheet processing apparatus 51, whereby the stapler 55 returns to the original position illustrated in FIG. 10. When the reader scanner portion 3 is pivoted downwardly, the stapling process to the sheet bundle can be performed.

When the maintenance involved with the staples is performed, the reader scanner portion 3 is pivoted upwardly to form the open space above the stapler 55. With this, the user can exchange the staples from the downstream side of the sheet processing apparatus 51. Accordingly, the user can exchange the staples from the front in many desktop image forming apparatuses, and its usability is improved.

In the present embodiment, the stapler 55 is configured to be capable of pivoting in order that a user can make an access to the staple cartridge, however, the stapler 55 may be configured to be detachable to the sheet processing apparatus 51. In this configuration, when the user exchanges the staples, he or she removes the stapler 55 together with the staple cartridge, and then, pulls out the staple cartridge from the stapler 55.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-112887, filed May 7, 2009, which is hereby incorporated by reference herein in its entirety.

What is claimed is:

1. An image forming apparatus comprising:

an image forming portion that forms an image on a sheet;

an image reading unit that reads an image on an original and is movably mounted above the image forming portion;

a sheet processing apparatus that processes the sheet having the image formed thereon by the image forming portion; and a stacking portion, disposed between the image forming portion and the image reading unit, on which the sheet processed by the sheet processing apparatus is stacked, wherein the sheet processing apparatus comprises a sheet conveyance path through which a sheet with an image formed by the image forming portion is conveyed, a process tray on which plural sheets conveyed through the sheet conveyance path are temporarily stacked, a binder which binds the sheets stacked on the process tray, and a reverse conveyance path, provided between the image reading unit and the sheet conveyance path, through which a sheet having an image to be conveyed to the image forming portion is reversely conveyed, wherein the sheet conveyance path is formed by a first portion which includes the process tray and a second portion which faces the process tray, and wherein the second portion is movably provided and has a first side forming the reverse conveyance path with a lower portion of the image reading unit, and a second side forming the sheet conveyance path with the first portion of the sheet processing apparatus, and wherein with an opening operation to move the image reading unit upwardly, the lower portion of the image reading unit moves away from the first side of the second portion so that the reverse conveyance path is opened, and with a further opening operation to move the image reading unit upwardly the second portion moves toward the lower portion of the image reading unit and away from the first portion so as to open the sheet conveyance path and the process tray.

2. An image forming apparatus according to claim 1, further comprising:

a sheet re-conveying portion that conveys the sheet, having an image formed on a first surface by the image forming portion, to the image forming portion; and wherein the reverse conveyance path and the sheet conveyance path are successively opened with the moving operation of the image reading unit upwardly.

3. An image forming apparatus according to claim 2, further comprising:

a link mechanism that moves the second portion with the moving operation of the image reading unit.

4. An image forming apparatus according to claim 1, wherein a staple cartridge is detachably mounted to the sheet processing apparatus, and a removing space through which the staple cartridge is removed is formed by opening the sheet conveyance path with the moving operation of the image reading unit.

5. An image forming apparatus according to claim 1, further comprising:

a conveying roller which conveys the sheet along the sheet conveyance path to the processing tray of the sheet processing apparatus;

a conveying portion which conveys the sheet bound by the binder onto the stacking portion ;and a hinge portion which pivots the image reading unit to rotate about an axis of the hinge portion disposed upstream of the processing tray in a sheet conveying direction.

6. An image forming apparatus comprising:

an image forming portion that forms an image on a sheet;

an image reading unit that is movably mounted above the image forming portion;

a sheet conveyance path through which a sheet with an image formed by the image forming portion is conveyed;

a process tray on which plural sheets guided by the sheet conveyance path are temporarily stacked;

a binder that binds the sheets stacked on the process tray; and a stacking portion on which the sheets bound by the binder are stacked and which is disposed between the image forming portion and the image reading unit, a reverse conveyance path, provided between the image reading unit and the sheet conveyance path, through which a sheet having an image to be conveyed to the image forming portion is reversely conveyed;

a movable guide portion that guides the sheet, with a first side of the movable guide portion forming the reverse conveyance path with a lower portion of the image reading unit, and a second side of the movable guide portion forming the sheet conveyance path, wherein with an opening operation to move the image reading unit upwardly, the lower portion of the image reading unit moves away from the first side of the movable guide portion so that the reverse conveyance path is opened, and with a further opening operation of the image reading unit the movable guide portion moves toward the lower portion of the image reading unit so that the sheet conveyance path is opened.

7. An image forming apparatus according to claim 6, wherein the sheet conveyance path and the process tray are opened with the moving operation of the image reading unit.

8. An image forming apparatus according to claim 6, further comprising:

a sheet re-conveying portion that conveys the sheet, having an image formed on a first surface by the image forming portion, to the image forming portion.

9. An image forming apparatus according to claim 6, further comprising:

a link mechanism that moves the movable guide portion with the moving operation of the image reading unit.

10. An image forming apparatus according to claim 6, further comprising:

a conveying roller which conveys the sheet along the sheet conveyance path to the processing tray;

a conveying portion which conveys the sheets bound by the binder onto the stacking portion; and a hinge portion which pivots the image reading unit to rotate about an axis of the hinge portion disposed upstream of the process tray in a sheet conveying direction.

11. An image forming apparatus according to claim 6, wherein a staple cartridge is detachably mounted to the binder, and a removing space through which the staple cartridge is removed is formed by opening the sheet conveyance path with the moving operation of the image reading unit upwardly.

12. An image forming apparatus comprising:

an image forming portion that forms an image on a sheet;

a movable unit that is movably mounted on the image forming portion;

a sheet conveyance path through which a sheet with an image formed by the image forming portion is conveyed;

a sheet processing portion that processes the sheet conveyed through the sheet conveying path; and a stacking portion on which the sheets processed by the sheet processing portion are stacked, a reverse conveyance path through which a sheet having an image to be conveyed to the image forming portion is conveyed; and a movable guide portion that guides the sheet, with a first side of the movable guide portion forming the reverse conveyance path with the movable unit, and a second side of the movable guide portion forming the sheet conveyance path, wherein with an moving operation to move the movable unit, the movable unit moves away from the first side of the movable guide portion so that the reverse conveyance path is opened, and with a further moving operation of the movable unit the movable guide portion moves toward the movable unit so that the sheet conveyance path is opened.

13. An image forming apparatus according to claim 12, further comprising:

a link mechanism that moves the movable guide portion with the moving operation of the movable unit.

14. An image forming apparatus according to claim 12, further comprising:

a hinge portion which pivots the movable unit to rotate about an axis of the hinge portion disposed upstream of the sheet processing portion in a sheet conveying direction.

15. An image forming apparatus according to claim 12, wherein a staple cartridge is detachably mounted to the sheet processing portion, and a removing space through which the staple cartridge is removed is formed by opening the sheet conveyance path with the moving operation of the moving unit.

16. An image forming apparatus according to claim 12, a sheet processing portion including a process tray on which plural sheets guided by the sheet conveyance path are temporarily stacked, and a binder that binds the sheets stacked on the process tray.

* * * * *